US005710582A

United States Patent [19]

Hawkins et al.

[11] Patent Number: 5,710,582

[45] Date of Patent: Jan. 20, 1998

[54] HYBRID INK JET PRINTER

[75] Inventors: William G. Hawkins, Webster; Ivan Rezanka, Pittsford; Roger G. Markham; Dale R. Ims, both of Webster; Donald J. Drake, Rochester, all of N.Y.

[73] Assignee: Xerox Corporation, Stamford, Conn.

[21] Appl. No.: 569,034

[22] Filed: Dec. 7, 1995

[51] Int. Cl.[6] ..... B41J 2/155; B41J 2/21

[52] U.S. Cl. ..... 347/42; 347/43

[58] Field of Search ..... 347/43, 42, 15, 347/13, 9; 395/101

[56] References Cited

U.S. PATENT DOCUMENTS

| | | | |
|---|---|---|---|
| Re. 32,572 | 1/1988 | Hawkins et al. | 156/626 |
| 4,774,530 | 9/1988 | Hawkins | 346/140 R |
| 4,829,324 | 5/1989 | Drake et al. | 346/140 R |
| 4,999,077 | 3/1991 | Drake et al. | 156/299 |
| 5,057,859 | 10/1991 | Ishimaru | 354/400 |
| 5,099,256 | 3/1992 | Anderson | 346/1.1 |
| 5,132,704 | 7/1992 | Nakagawa | 346/76 PH |
| 5,136,305 | 8/1992 | Ims | 346/1.1 |
| 5,138,336 | 8/1992 | Goto | 346/76 |
| 5,160,945 | 11/1992 | Drake | 346/140 R |
| 5,192,959 | 3/1993 | Drake et al. | 346/140 R |
| 5,198,054 | 3/1993 | Drake et al. | 156/64 |
| 5,221,397 | 6/1993 | Nystrom | 156/273.5 |
| 5,257,043 | 10/1993 | Kneezel | 346/140 R |
| 5,270,738 | 12/1993 | Takahashi et al. | 346/140 R |
| 5,280,308 | 1/1994 | Takahashi et al. | 346/134 |
| 5,343,227 | 8/1994 | Hirosawa et al. | 349/42 |
| 5,365,645 | 11/1994 | Walker et al. | 29/25.35 |
| 5,398,053 | 3/1995 | Hirosawa et al. | 347/13 |
| 5,402,527 | 3/1995 | Bigby et al. | 395/101 |
| 5,444,469 | 8/1995 | Cowger | 347/14 |
| 5,587,730 | 12/1996 | Karz | 347/43 |

FOREIGN PATENT DOCUMENTS

| | | |
|---|---|---|
| 0227483 | 7/1987 | European Pat. Off. . |
| 60-110456 | 6/1985 | Japan . |
| 1-123381 | 5/1989 | Japan . |

*Primary Examiner*—Benjamin R. Fuller
*Assistant Examiner*—Thinh Nguyen

[57] ABSTRACT

An ink jet printer is configured in a hybrid architecture wherein a full width printbar is combined with a partial width color scanning assembly to provide the capability of selectively printing in black only or, alternately, of producing color prints by operating the color scan assembly exclusively. The cost of the hybrid system, when compared to a full width color system using four full width printbars, is greatly reduced. Throughput time is reduced by providing the control circuitry for distinguishing between black only and color operation and selectively controlling the printer mode of operation. The hybrid architecture is particularly useful in a LAN system since it provides a mechanism for balancing the relative color versus black page decomposition speed limitations. Also, the hybrid architecture enables a relatively simple implementation of a checkerboarding technique to suppress banding in output prints.

9 Claims, 3 Drawing Sheets

HYBRID INK JET PRINTER

BACKGROUND AND MATERIAL DISCLOSURE STATEMENT

The present invention relates to ink jet printing and, more particularly, to a hybrid ink jet printer which combines a single black pagewidth array printbar with one or more partial width array scanning printheads for color printing.

Conventionally, most commercial ink jet printers are of the partial width array scanning type wherein a printhead module, typically one inch in width and containing a plurality of ink ejecting nozzles or jets, is mounted on a carriage which is moved in a scanning direction perpendicular to the path of motion of a recording medium such as paper. The printhead is in fluid communication with an ink supply cartridge. After each line scan by the printhead, the recording medium is advanced, and the printhead is scanned again across the medium. A black only scanning printer is disclosed, for example, in U.S. Pat. No. 5,136,305. For color printing, additional printhead modules and associated color ink jet cartridges are added to form a configuration of the type disclosed, for example, in U.S. Pat. No. 5,099,256, whose contents are hereby incorporated by reference. Printers such as the Xerox 4004, Canon Bubble Jet, and Hewlett Packard Desk Jet printers all use a scanning printhead architecture.

Pagewidth ink jet printers are known in the art which utilize one or more full pagewidth array printbars. In these pagewidth printers, a printbar is fixed in position adjacent to the path of the recording medium. Since there is no scan and re-scan time, a much higher print speed (on the order of 10:1) is enabled. One full width print bar may be used for a black only system; additional full width color printbars may be added to enable a highlight or full color printer.

U.S. Pat. Nos. 5,280,308, 5,343,227, and 5,270,738 disclose full color pagewidth printers with four printbars, black, cyan, magenta, and yellow.

Various methods are known for fabricating pagewidth arrays. One method is to form a linear pagewidth printbar by end-to-end abutment of fully functional printhead elements. U.S. Pat. Nos. 5,192,959, 4,999,077, and 5,198,054 disclose processes for forming linear printbars of butted subunits. An alternate method is to form partial printheads on both sides of a substrate in a staggered orientation and stitch together the outputs to produce a full width printbar. U.S. Pat. Nos. 4,829,324, 5,160,945, 5,057,859, and 5,257,043 disclose pagewidth arrays having two or more linear staggered arrays of printhead submodules.

A full width (12") array printbar which records at a resolution of 600 spi will typically have 7,200 nozzles or jets aligned linearly. For a full color printer with four full width printbars, 28,800 jets are in use.

A major consideration when designing a pagewidth color printer is the cost of the full width printbars which are typically order of magnitude higher than the cost of the smaller scanning array.

A second consideration arises when the printer is used in a Local Area Network (LAN) configuration. LANS provide a means by which users running dedicated processors are able to share resources such as a printer, file server and scanner. LANS have a variety of print drivers emitting different page description languages (PDLs) which are directed to specific printer devices. The PDL must be decomposed, typically by a dedicated print server, to convert the PDL file (typically Interpress™ or Postscript®) into bitmapped files for application to the printer. The decomposition time of color images is several times as long as for text (black) pages. The long decomposition times are a consequence of both the graphical as opposed to the text content of the pages as well as the need for four color separations as opposed to a single black separation. When the printer is a desktop ink jet printer, in spite of the fact that the intrinsic throughput of the printer in color is typically four times slower, there is an additional slowdown caused by the electronics' inability to render the image at the maximum rate at which the printer can support. Therefore, the balancing of the printer marking capability in color versus monochrome involves a tradeoff tending to reduce the color capability.

A third consideration is associated with the decision which must be made in the printer as to when to print a color image. Since the color portion of a page being printed may not occur until the very end of the page, this could, in principle, require the acquisition and rendering of the entire page before the electronic controller can make the decision, thus slowing the process time.

A fourth consideration is how best to compensate for the condition known as "banding" when printing graphics and partial tone images. Banding is caused by slight, but persistent, jet misdirection which is present as a result of process imperfections as well as dirt and particulates in the vicinity of the misdirecting jet. In addition to misdirection, spot size variations can also be present and cause noticeable defects. In the scanning printer architecture, this type of persistent banding noise can be dramatically suppressed by printing the images in a checkerboard pattern. A characteristic checkerboard pattern can be implemented which has the effect of randomizing the persistent noise image and reducing or eliminating image noise. The extension of the checkerboarding techniques to a pagewidth printer is possible but requires that the recording medium (rather than the fixed printbars) be moved, thus requiring a more complex architecture and timing sequence.

SUMMARY OF THE INVENTION

It is, therefore, one object of the invention to reduce the expense associated with a pagewidth color printer having four full width printbars.

It is another object to balance the relative color versus black page decomposition speed limitations of electronics in a LAN printer.

It is a further object to eliminate the delays associated with detection of color image placement on the printed page.

It is a still further object to enable a checkerboarding technique to reduce the banding effect when making color images.

These and other objects are realized by providing a hybrid color printer which contains both a full width printbar and partial width printheads to achieve a low printer cost, a balance of the electronics with the capability of the printer, and simplified checkerboarding to reduce banding.

More particularly, the present invention relates to a hybrid ink jet printer for recording images on a recording medium, the printer including:

a full width printbar and a scanning assembly including at least two partial width printheads.

Further, the application also applies to a hybrid ink jet printer for recording images on a recording medium, operational in a first black only mode of operation or in a second color mode of operation characterized by including:

a full width printbar for printing in a black only mode, a scanning color printhead assembly for printing in a color mode of operation and printer control means for receiving input PDL signals and selecting the mode of operation in response to an analysis of the information contained in the PDL.

DESCRIPTION OF THE INVENTION

Figure 1:
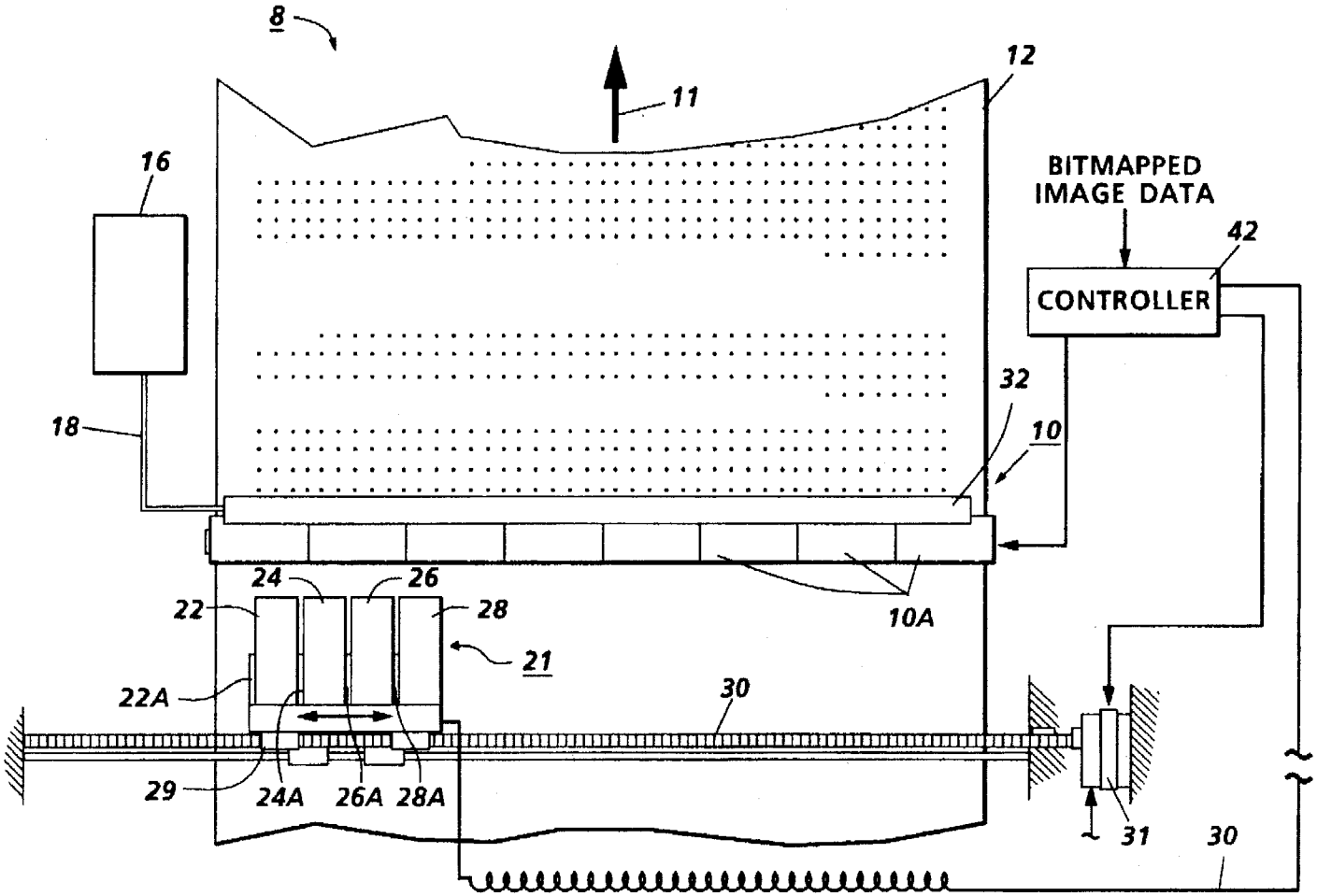
FIG. 1 is a partial frontal view of a hybrid color printer according to the invention incorporating a full width black printbar and a color scanning assembly incorporating four partial width color printbars.

The hybrid printer of the invention enables a single paper path and controller to be efficiently utilized for high-speed monochrome printing as well as full-coloring printing. FIG. 1 shows one embodiment of the invention wherein a hybrid printer 8 includes a full width black printbar 10 positioned to write on a recording medium 12 which is indexed by a motor (not shown) and moves in the direction of arrow 11. Printbar 10 has been assembled from a plurality of modules 10A which have been butted together to form a 12" printbar according to the techniques described, for example, in U.S. Pat. No. 5,221,397, whose contents are hereby incorporated by reference. Printbar 10, in this embodiment, provides 7,200 nozzles or jets. As described in the '397 patent, the printbar modules 10A are formed by butting together a channel array containing arrays of recesses that are used as sets of channels and associated ink reservoirs and a heater wafer containing heater elements and addressing circuitry. The bonded wafers are diced to form the printbar resulting in formation of the jets, each nozzle or jet associated with a channel with a heater therein. The heaters are selectively energized to heat the ink and expel an ink droplet from the associated jet. The ink channels are combined into a common ink manifold 32 mounted on the side of printbar 10 and in sealed communication with the ink inlets of the channel arrays through aligned openings. The manifold 32 is supplied with the appropriate ink, black for this embodiment, from an ink cartridge 16 via flexible tubing 18.

Also shown in FIG. 1, is a color printhead assembly 21 containing several ink supply cartridges 22, 24, 26, 28 each with an integrally attached printhead 22A, 24A, 26A, 28A. Cartridge 22 supplies black ink to printhead 22A, cartridge 24 supplies magenta ink to printhead 24A, cartridge 26 supplies cyan ink to printhead 26A, and cartridge 28 supplies yellow ink to printhead 28A. Assembly 21 is removably mounted on a translatable carriage 29 which is driven along lead screw 30 by drive motor 31. The printheads 22A, 24A, 26A, 28A are conventional in construction and can be fabricated, for example, according to the techniques described in U.S. Pat. No. Re. 32,572 and 4,774,530, whose contents are hereby incorporated by reference.

Figure 2:
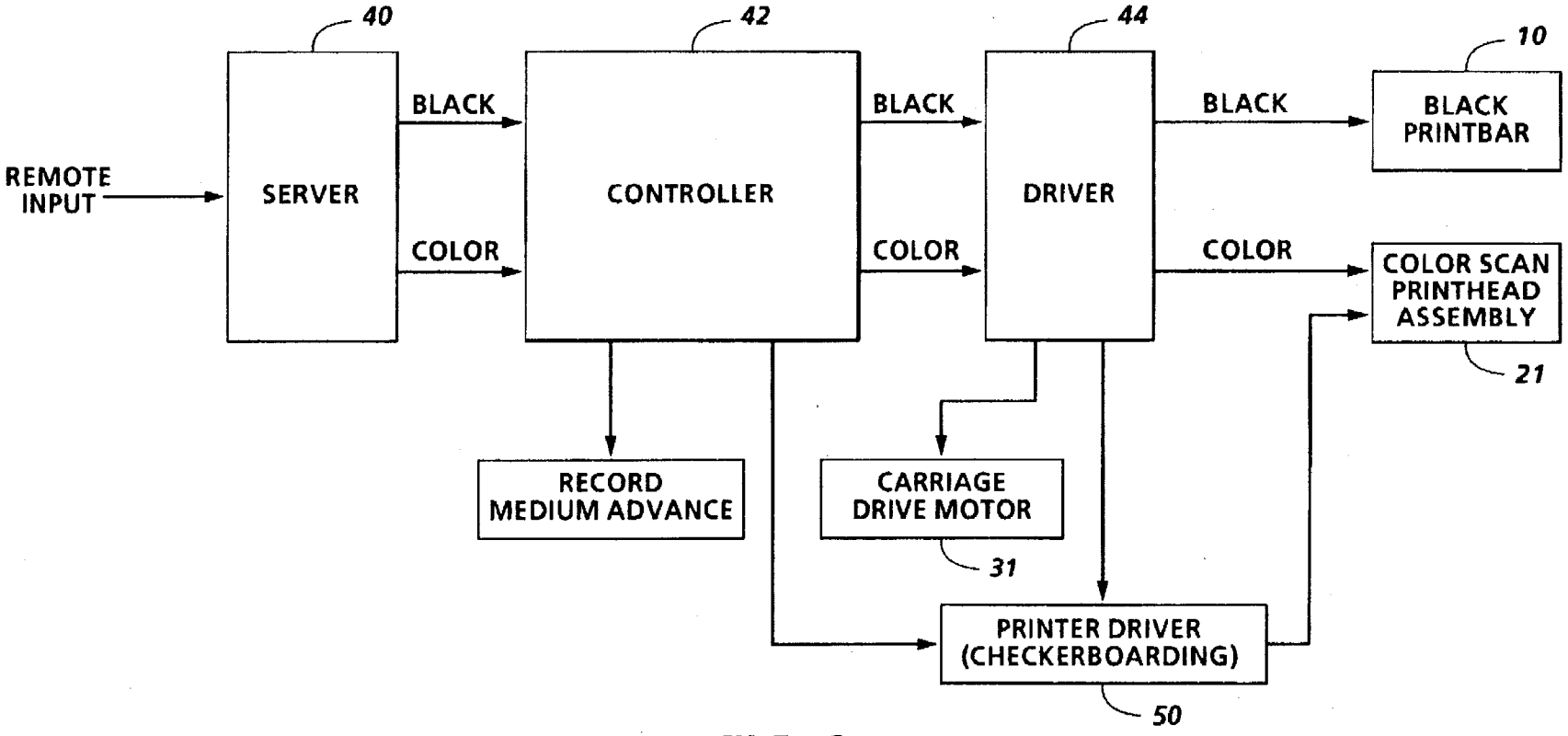
FIG. 2 is a schematic block diagram of the imaging and control system for operating the hybrid printer of FIG. 1.

FIG. 1 is a hybrid printer which can be operated either as an all black printer by operating the black pagewidth printbar 10 or as a color printer by operating scanning assembly 21. The control system for selectively enabling an all black or a color mode of operation is shown in FIG. 2. FIG. 2 is a schematic diagram showing the processing of the data input drive signals for printer 8. Printer 8 can be, for this example, an element of a LAN system, although the hybrid printer of the invention can be used in other types of non-LAN systems.

Referring to FIG. 2, for purposes of description, it is assumed that an electronic document has been generated by a personal computer (PC) workstation and is to be printed by hybrid printer 8 (FIG. 1) over a LAN which includes a shared file server 40. It is further assumed that the remote input is written in Interpress™. Print server 40 functions as a "spooler" to buffer the jobs that are sent to it as well as a page description language (PDL) "decomposer" for converting the PDL file (for this case, Interpress™) to bitmaps consisting of pixel information for application to the printer. Each bitmap consists of bits representing pixel information in which each scan line contains information sufficient to print a single line of information across the width of medium 12. The Interpress™ standard for representing printed pages digitally is supported by a wide range of Xerox® Corporation products. Interpress™ instructions from a remote workstation are transformed into a format understood by the printer. The Interpress™ standard is comprehensive; it can represent any images that can be applied to paper (including complex graphics) and a wide variety of font styles and characters. Each page of an "Interpress™" master can be interpreted independently of others. Further details of operation of print servers operating in a LAN are found, for example, in U.S. Pat. No. 5,402,527, whose disclosure is hereby incorporated by reference.

Continuing with a description of FIG. 2, the outputs of server 40 are bitmapped files representing pages to be printed. The black and color output signals from server 40 are sent to controller 42. Controller 42 analyzes the bitmapped inputs and supplies the printhead drive signals to either the pagewidth printbar 10 or the color scanning assembly 21 via driver circuitry 44. The drive signals are conventionally applied via wire bonds to drive circuitry and logic on each module 10A of printbar 10 and each printhead 22A–28A. Signals are pulsing signals which are applied to the heat generating resistors formed in the associated ink channels for each ink jet. Controller 42 may take the form of a microcomputer including a CPU, a ROM for storing complete programs, and a RAM. Controller 42 also controls other machine functions such as feeding of the recording sheet 12, movement of the scanning carriage 29 by control of motor 31, and operation of assembly 21 in a checkerboarding mode as described below.

In a typical print operation, server 40 reads the header of the PDL page to determine whether any portion of the page is color. If the determination is that there is no color; e.g., that the page is simply all black text or graphics, the completely decomposed signal is sent via the controller to operate the printbar 10 to print out at high speed the monochrome text. If the next page header read by server 40 indicates the presence of a color image, the decomposition time will be four times longer than the preceding black only page. The decomposed color image is sent via the controller to the driver 44 to drive the color scanning assembly 21. At least part of the longer decomposition time takes place during the monochrome printing of the preceding page enhancing the throughput. The PDL page header detection decomposition and relaying to the appropriate printhead is repeated until the entire document or page has been printed. It is seen that the printing throughput is increased to the maximum rate at which the printer can support.

In a variation of the invention, and depending on the severity of banding and mottle caused by the process and physical characteristics of the system, a multi-step or checkerboarding circuit 50 can be utilized to randomize the persistent noise image and suppress the banding and mottle. If a determination is made that the printer 8 is experiencing banding problems, the controller 42 is programed to route the decomposed color bitmap to the alternate printer driver checkerboarding circuit 50. The signals applied to scanning assembly 21 will cause the printing of a first pattern along a swath path and then deposits a second dot pattern complimentary in spacing to the first pattern. The second pattern of dots overlaps the first pattern by a predetermined percentage of the surface of the first pattern (typically 50%). The process further includes alternating the adjacent spacing of dots in coincident rows of dots in the first and second pattern of dots with overlapping areas of the patterns. The print quality of printer 8 is significantly enhanced by this process.

In summary, a hybrid printer has been described which comprises a single black full width printbar with a scanning assembly of partial width printheads. This hybrid printer simultaneously balances the relative color versus black page decomposition time limitations of the electronics of printers. The large expense of using four full width printbars is greatly reduced. Banding suppression is made easier by use of the color scanning assembly. The more demanding color pages can be printed with banding suppression while the deconstructed monochrome text pages are printed at a high speed.

Figure 3:
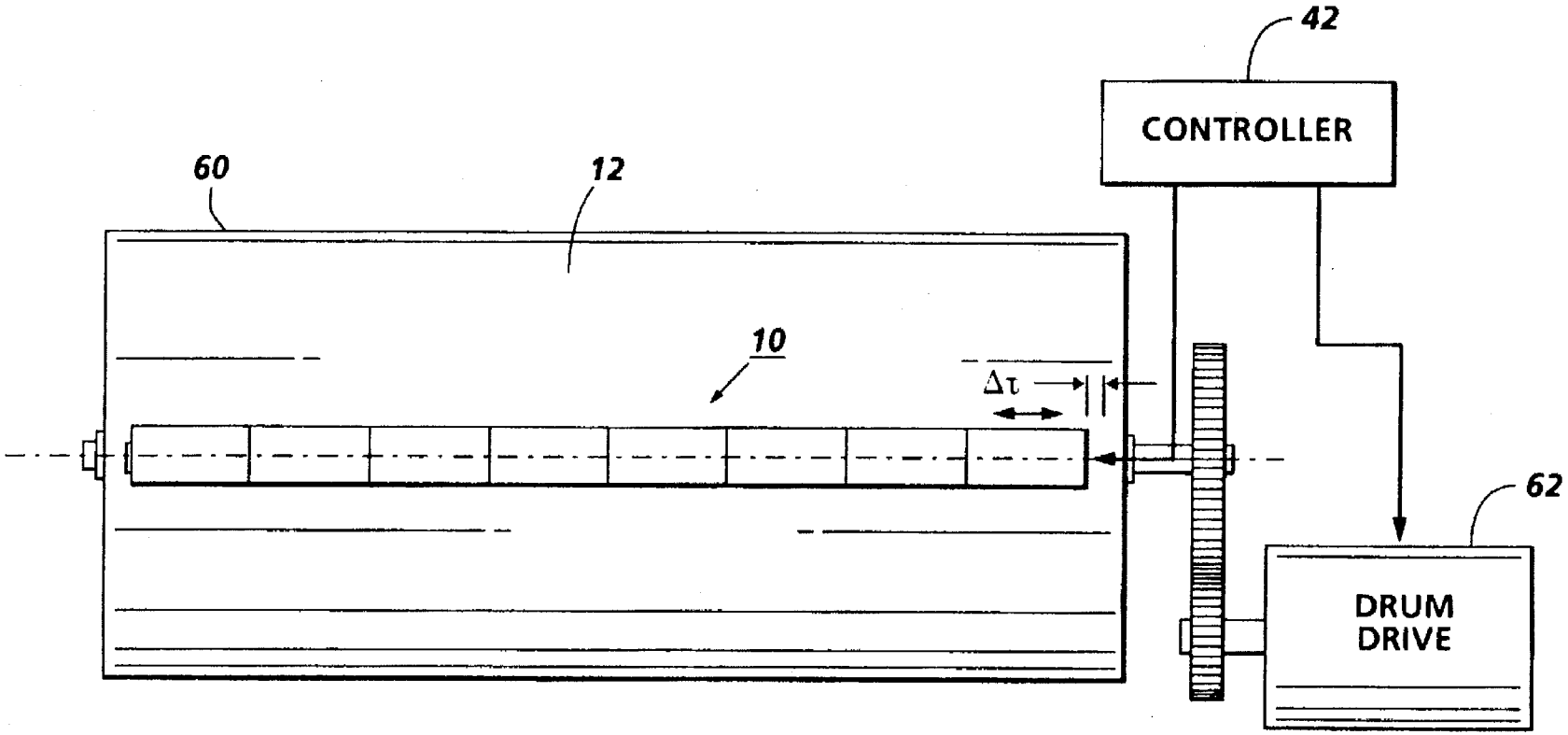
FIG. 3 is a partial schematic front view of a hybrid color printer printing onto a recording medium held on a rotating drum.

While the hybrid printer has been shown in an embodiment where printing is onto a recording medium, such as paper moving in a horizontal plane past the printheads, the hybrid architecture can also be enabled by printing onto a recording medium entrained on a curved surface such as a drum described, for example, in U.S. Pat. No. 5,043,740, whose contents are hereby incorporated by reference. Depending on the severity of banding and mottle, checkerboarding can be utilized also to suppress these print quality defects for printing the black images with the pagewidth printbar. As shown in FIG. 3, pagewidth printbar 10 is positioned over the width of a drum 60 which carries recording medium 12 entrained along its circumference. The color printhead assembly and black ink supply system and other control system elements are omitted for purposes of summarizing the description of the following feature. In the printer architecture shown in FIG. 3, the recording medium is held on the rotating drum 60 and can pass under the pagewidth printbar 10 more than once. Only half of the black pixels are printed during the first passage of the recording medium 12 under the printbar 10, and the remaining pixels are printed in the second passage of the medium 12. Drum rotation is controlled by signals from controller 42 applied to drum drive 62. As an additional improvement, the printbar is shifted laterally by a small distance $\Delta t$ and the pixels of the same line in process direction are printed with different jet in the second pass. This leads to further improvement by randomization of the directionality and drop volume errors.

Further, while the invention contemplates operation in a thermal ink jet printer wherein resistors are selectively heated to causing ink ejection from an associated nozzle, the invention is also applicable to other types of ink jet printers such as, for example, piezoelectric printer of the type disclosed in U.S. Pat. No. 5,365,645, whose contents are hereby incorporated by reference. Also, while a full color scanning assembly of four printheads was described, the scanning assembly can have fewer printhead cartridges. As an example, if the printer is to operate in a highlight color mode, two printheads, one black and one selected color, may be used. Also a three printhead, three color scanning assembly can be used.

While the embodiments disclosed herein are preferred, it will be appreciated from this teaching that various alternative modifications, variations or improvements therein may be made by those skilled in the art which are intended to be encompassed by the following claims:

What is claimed is:

1. A thermal ink jet printer forming part of a shared LAN wherein at least one full page width printbar is positioned adjacent a recording medium to record black images thereon, comprising, in combination, a partial width color printhead assembly mounted in a scanning mode of operation across the width of the recording medium to record color images thereon and control means for receiving image print signals written in a PDL from a remote source and for adapting these signals to create drive signals for selectively operating said full width printbar and said color printhead assembly in a recording mode of operation and wherein said control means further includes printer server means for decomposing said print signals and generating bitmap signals for operating drive circuitry associated with said full width printbar and said color assembly, said printer server means further examining color header information for said PDL image print signals and, upon identifying color information is present in said header information, decomposing the image and sending the decomposed output signals to the color assembly while, alternately, when noting the lack of color information in the header, decomposing the image print signals and routing the decomposed print signals image directly to the full width printbar.

2. The printhead of claim 1 wherein the at least one full width printbar includes a source of black ink and wherein the printbar records a black image onto the recording medium.

3. The printer of claim 1 wherein said partial width scan assembly includes a first printhead for printing black images and a second, third and fourth printhead for printing magenta, cyan, and yellow images, respectively.

4. The printhead of claim 3 wherein said printer receives page print information in a page description language and wherein said control means includes print server means for determining whether pages having color information to be printed and for decomposing said page to provide a bitmap output.

5. The printer of claim 4 further including drive circuitry for conveying print signals to said full width printbar and said scanning assembly, and wherein the bitmap output signal is selectively sent to either the full width printbar or the scanning assembly.

6. The printer of claim 1 wherein the recording medium is contained on a curved surface.

7. The printer of claim 6 wherein said curved surface is incorporated into a rotatable drum and wherein said control means controls the operation of the full width printbar and the rotation of the drum so that one-half of the black pixels are printed during a first complete rotation of the drum while the remaining pixels are printed during the second rotation of the drum.

8. The printer of claim 7 wherein said control means shifts the printbar a lateral distance $\Delta t$ at the end of the first drum rotation.

9. A hybrid ink jet printer for recording images on a recording medium in response to page print information in a page description language, the printer including:

at least one full width printbar, a scanning assembly including a plurality of partial width printheads, at least one of said printheads printing images of a selected color, control means for selectively controlling a print operation to operate at least said one full width printbar and said scanning assembly, said control means including print server means for determining whether pages have color information to be printed and for decomposing said page to provide a bitmap output signal to provide bitmap output signals and drive circuitry for conveying print signals to said at least one full width printbar and said scanning assembly, and wherein the bitmap output signals are selectively sent to each of the at least full width printbar or the scanning assembly.

* * * * *